US005544759A

United States Patent [19]

Urizar

[11] Patent Number: 5,544,759

[45] Date of Patent: Aug. 13, 1996

[54] PROCEDURE AND APPARATUS FOR MATERIALS SEPARATION BY PNEUMATIC FLOTATION

[76] Inventor: Daniel F. Urizar, Estado 235 Of. 511, Santiago, Chile

[21] Appl. No.: 417,399

[22] Filed: Apr. 5, 1995

Related U.S. Application Data

[63] Continuation-in-part of Ser. No. 187,461, Jan. 28, 1994, abandoned.

[30] Foreign Application Priority Data

Jan. 29, 1993 [CL] Chile ..... 0113-93

[51] Int. Cl.[6] ..... B03D 1/24

[52] U.S. Cl. ..... 209/164; 209/168; 209/170

[58] Field of Search ..... 209/164, 168, 209/169, 170; 210/221.2

[56] References Cited

U.S. PATENT DOCUMENTS

| | | |
|---|---|---|
| 1,232,772 | 7/1917 | Crerar . |
| 1,317,244 | 9/1919 | Towne et al. . |
| 1,491,110 | 4/1924 | Spearman . |
| 1,497,804 | 6/1924 | Spearman . |
| 1,509,266 | 9/1924 | Spearman . |
| 1,579,722 | 4/1926 | McAtee . |
| 1,813,082 | 7/1931 | Pudan . |
| 1,952,727 | 3/1934 | Ralston . |
| 2,120,535 | 6/1938 | Wilkinson . |
| 2,221,008 | 11/1940 | Traylor . |
| 2,267,496 | 12/1941 | Ellis . |
| 2,518,451 | 8/1950 | Daman . |
| 2,646,882 | 7/1953 | Frost . |
| 2,753,045 | 7/1956 | Hollingsworth . |
| 2,905,322 | 9/1959 | Cannon . |
| 4,190,522 | 2/1980 | Tra . |
| 5,039,400 | 8/1991 | Kallioinen . |
| 5,234,112 | 8/1993 | Valenzuela . |
| 5,251,764 | 10/1993 | Niiti . |

*Primary Examiner*—Thomas M. Lithgow

[57] ABSTRACT

The invention relates to a method and an apparatus for the separation of hydrophobic substances by froth flotation that basically consists of feeding pulp in the form of a thin layer on at least a lower gas-permeable slanted surfaces in which low pressure gas is injected generating small bubbles that collect hydrophobic particles. The froth containing concentrate is separated and washed before removal in a froth reservoir formed by a lower gas-permeable slanted surface and a wall at its lower end. At the top of the wall, the froth overflows to a launder for removal. At the bottom of the wall, the pulp containing the tailings discharges through an opening. Froth washing is performed by means of baffles that force the froth to flow underneath water sprays.

25 Claims, 3 Drawing Sheets

PROCEDURE AND APPARATUS FOR MATERIALS SEPARATION BY PNEUMATIC FLOTATION

This a continuation-in-part of application Ser. No. 187, 461, filed Jan. 28, 1994, now abandoned.

BACKGROUND OF THE INVENTION

FIELD OF THE INVENTION

This invention is in the field of methods for the separation of materials suspended in liquid environments using froth flotation techniques in which hydrophobic particles are recovered from a pulp. The invention consists of a new collection and cleaning method and apparatus for carrying out the flotation technique.

DESCRIPTION OF THE RELATED ART

There are several industrial applications of the flotation process that take advantage of the differences in the hydrophobicity of materials. Some of the typical applications include the beneficiation of minerals and organic hydrophobic materials.

The flotation process involves three phases: solid, liquid and gas. The solid phase includes the hydrophobic material to be separated (concentrate) and the unwanted material (tailings). The liquid phase consists of water or another liquid which is associated with the solid in a natural way or as the result of an industrial process. The gas phase consists of air or any gas inert with respect to the solids involved in the separation. The gas is injected into the pulp to generate bubbles which collide and attach to the hydrophobic particles forming a froth phase on top of the pulp. The unwanted material or tailings, on the other hand, remains in the bulk.

There are several methods and apparatus that can carry out materials separation by the above mentioned flotation technique. The state-of-the-art flotation methods can be divided into three main groups based on the type of operation and vessel design used in the process.

The first group of flotation methods is based on mechanical operation and considers feeding the pulp into a vessel kept agitated in order to maintain it well homogenized. The pulp is fed into an agitated tank while gas is injected through the shaft of the agitator, either by pressure or self-induction. In order to increase bubble-particle collision efficiency, baffles are installed to produce small bubbles. Tailings are removed from the bottom while the concentrate is collected in a launder.

The apparatus used in this first group differ among themselves in design and size. They vary in the agitation mechanisms and vessel shape. Their volume can reach 100 $m^3$ and their height over 2 m.

A second group of flotation methods is based on pneumatic operation. This method considers conditioning the pulp with the appropriate reagents and feeding it into a vessel in which gas is injected by a device located outside the vessel. The device, an aerator, generates bubbles finely dispersed in the pulp. The collision-adhesion process takes places at the pulp feeding point. The froth (concentrate) overflows to launders while the tailings discharge from the bottom.

A third group of flotation methods is also based on pneumatic operation. In this case the vessel is a column with a diameter much smaller than its height. In this kind of column, two zones are observed: (1) a collection zone, the region between the gas injection point and the pulp-froth interface, and, (2) a froth zone, bounded by the pulp zone interface and the overflow point. The pulp is usually fed halfway the height of the column. Since gas injection takes place at the bottom of the column, bubble-particle adhesion occurs when rising bubbles collide with particles descending in the collection zone. In this way, collected particles rise to the froth zone and overflow at the top of the column.

Generally, column flotation cells require heights over 10 m in order to attain adequate bubble-particle collision probabilities, and therefore, relatively high gas injection pressures are necessary.

Mean residence time in any of the flotation methods just mentioned ought to exceed 5 min. in order to achieve acceptable recoveries.

The present invention offers a combination of novel characteristics that result in more efficient flotation methods and apparatus. Several inventions in the field of solids separation share some of the characteristics of the present invention but have drawbacks that decrease their selectivity and/or recovery or even in some cases make it unsuitable for solids separation.

The patent to Ellis U.S. Pat. No. 2,267,496 uses, in a first unit, an external conditioning tank for performing the collection stage of the flotation process and a second unit for the separation of the hydrophobic and hydrophilic materials. In this second unit the separation between the concentrate and tailings is carried out by divecling a stratum of the pulp-froth stream by means of skimmers located above a slanted surface. This technique is not flexible to changes in the flow than overflowing froth because it decreases selectivity when there is an increase in the thickness of the pulp layer by removing pad of the material in the pulp. Also, recovery decreases by not divecling the entire froth when the flow decreases and the pulp layer is thinner than the gap below the skimmers.

Spearman U.S. Pat. No. 1,491,110, discloses an apparatus that uses gas injection through a gas-permeable surface, like the present invention. However, in this case, the apparatus performs a process in which air is used to condition the pulp particles for agglomeration and segregation. Moreover, agglomerated particles are removed using a suction equipment and, if this apparatus were applied as a flotation unit the results would be extremely poor because it lacks a froth separation stage.

Crerar U.S. Pat. No. 1,232,772, discloses a method for solid separation that, like the present invention, uses a gas-permeable surface to generate froth. However, in this method the entire pulp in converted into a froth that is maintained until the separation of the desired and undesired materials has been effected. Thus, the process of C, rerar does not generate two phases, froth and pulp, and without such separation, it appears unlikely that selectivity can be achieved in the separation of the hydrophobic and hydrophilic materials. Also, no froth cleaning step is considered to remove hydrophilic particles mixed with the hydrophobic particles in the frothing step.

The present invention performs the process but has several characteristics that distinguish it from the state-of-the-art flotation techniques:

The particle collection and froth phase-pulp separation occur in the same apparatus.

The bubble-particle collisions occur in thin layer of pulp allowing fast collection rates.

The froth separates from the pulp in an aerated environment that decreases backmixing and thus reduces separation volume.

The gas is injected into the cell at low pressure, usually less than 2 psig.

The apparatus does not require mechanical agitation.

The concentrate and the tailings flow concurrently and discharge from the apparatus by gravity.

As a result of the combination of these factors, flotation time and energy consumption are greatly reduced while process efficiency increases.

SUMMARY OF THE INVENTION

This invention consists of performing a froth flotation process that comprises the stages of particle collection and froth phase—pulp separation in a single apparatus in which air is injected into the pulp, flowing in the form of a thin layer, through a gas-permeable slanted surface.

The thin layer of pulp, preferentially less than 5 mm thick, is generated by means of a distributor in the upper end of a gas-permeable slanted surface so that low pressure gas injected through it collects hydrophobic solids. The pulp, conditioned with the appropriate reagents, flows by gravity and is distributed across the width of the slanted surface.

In a reservoir formed by a gas-permeable slanted surface and a wall at the downstream end, the aerated pulp separates into a froth phase containing the hydrophobic material and a pulp containing the hydrophilic solids.

Froth cleaning is carried out using baffles that force the froth to flow underneath a water-spraying system. The froth (concentrate) overflows the reservoir while the tailings discharge from the bottom.

In order to better understand the invention, the method will be explained and an example of the apparatus for performing it presented.

DETAILED DESCRIPTION OF THE INVENTION

This method of the invention consists of performing a froth flotation process that comprises the stages of particle collection and froth phase-pulp separation in one apparatus. Thus, two zones can be recognized in the apparatus used to perform such method: a collection zone where pulp feeding and product collection occurs and, a cleaning zone where froth separation and cleaning is carried out.

In the collection zone, pulp is fed in the form of a thin layer of pulp, preferentially less than 5 mm thick, on top of a gas-permeable slanted surface. The pulp, previously conditioned with the appropriate reagents is uniformly distributed in the upper end of the lower slanted surface and flows downward by gravity.

Product collection occurs as the bubbles formed at the gas-permeable slanted surface collide and contact the hydrophobic particles in the pulp.

In the cleaning zone, gas is injected into the pulp and the froth phase separates from the pulp flowing downward on a slanted gas-permeable surface. The froth accumulates in the cleaning zone between the slanted surface and a wall at its lower end and discharges the apparatus by overflowing this wall.

Froth cleaning is performed by means of baffles located above the slanted surface forcing the froth to flow underneath a water sprinkling system, causing drainage of hydrophilic material.

The pulp carrying the hydrophilic material discharges through a gap at the bottom of the cleaning zone.

The preferential angle for the slanted surfaces is 15° but can be changed between 5° and 30° with respect to the horizontal level depending on the application.

An apparatus has been built in order to obtain a better understanding of the froth flotation method and of the modifications that can be introduced without changing the basic principles behind the invention.

Figure 1:
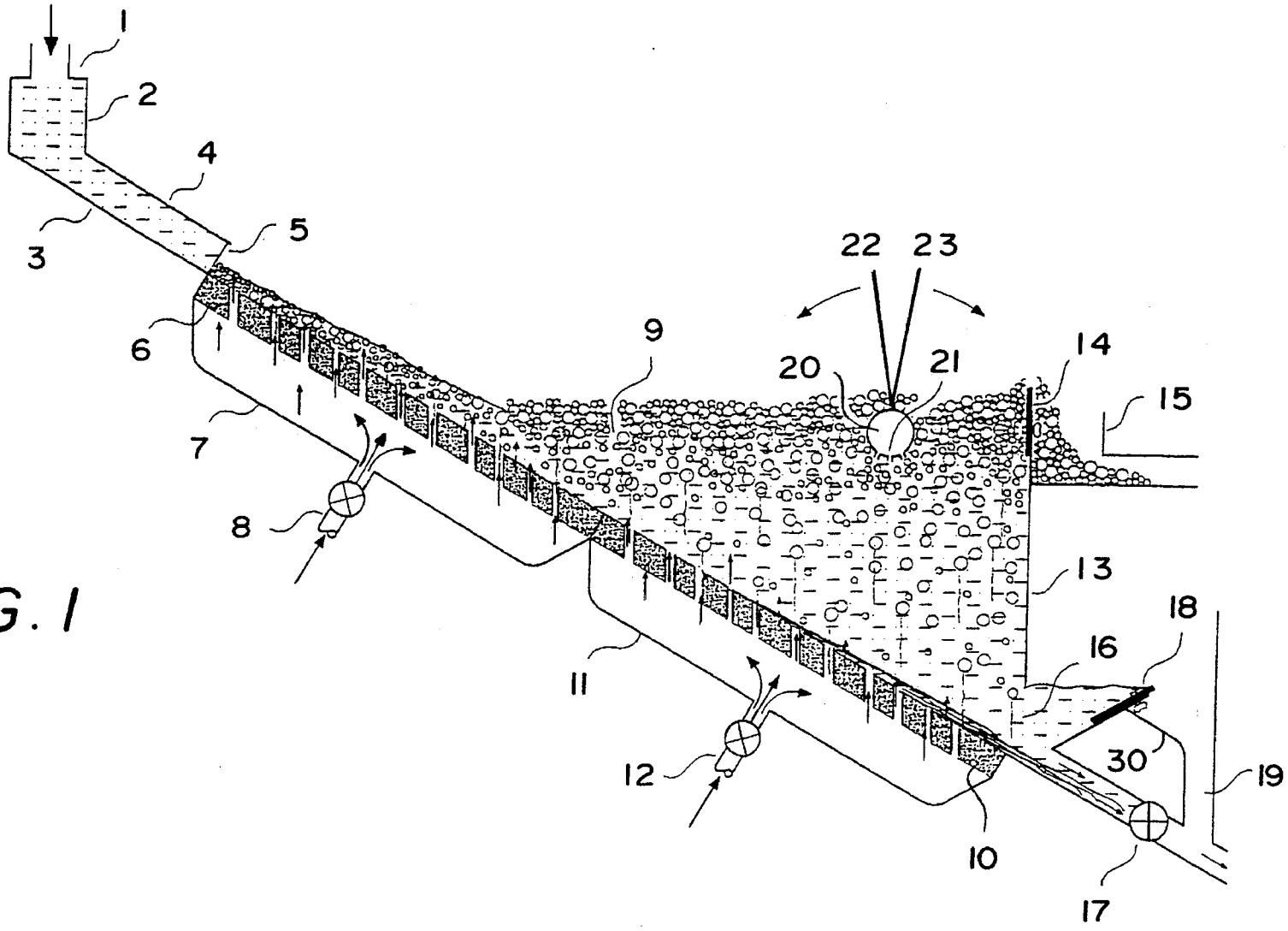
FIG. 1 is a longitudinal view of a first embodiment of the apparatus used to carry out the method.

FIG. 1 shows a longitudinal section of a first embodiment of an apparatus for performing the method of the invention.

In this apparatus the pulp is fed from a pipe or any other external device to a feeding line 1 located in the upper part of the apparatus. The feeding line 1 discharges to feeding vessel 2. From this feeding vessel 2, the pulp flows downward on an inclined plate 3. Above this inclined plate 3, a cover 4 is used to define the maximum thickness of the pulp layer entering the collection zone through a distribution plate 5. This distribution plate 5 is located in a manner transversal to inclined plate 3 and provided with evenly spaced openings across the entire width of its lower end in order to make sure that the pulp forms a thin layer on a lower slanted gas-permeable surface 6.

On top of lower slanted gas-permeable surface 6 pulp flows downward by gravity while low pressure gas, preferentially air, is injected from a gas chamber 7. The gas is produced and/or compressed externally and fed to gas chamber 7 through a line 8 provided with valves and pressure regulators.

In the collection zone, the hydrophobic particles in the pulp adhere to the bubbles generated at the pores of lower slanted gas-permeable surface 6. The aerated pulp discharges to a froth separation reservoir 9 in the cleaning zone.

At the bottom of the froth separation reservoir 9 there is a second slanted gas-permeable surface 10 that is a continuation of the lower gas-permeable surface 6 in the collection zone. The second slanted gas-permeable surface 10 sits on top of a gas chamber 11 fed with gas, preferentially air, produced and/or compressed externally through a line 12 provided with its own valve and pressure regulators that allow gas flow and pressure control independent of gas chamber 7 in the collection zone.

At the lower end of second slanted gas-permeable surface 10 froth separation reservoir 9 is limited by a wall 13 that can be vertical or inclined. This wall 13 permits the separation of the froth phase from the pulp carrying the hydrophilic particles. Froth overflows a height-adjustable plate 14 located at the upper end of wall 13 and is withdrawn from the apparatus through a launder 15.

At the lower end of wall 13, the tailings discharge through an opening 16 that allows coarse material in the tailings discharges through a control valve 17 located downstream opening 16.

Located downstream opening 16 and upstream control valve 17 there is a height-adjustable plate 18 that allows fines in the tailings to overflow to a launder 30 that discharges to a duct 19 and combine with the coarse material. By varying the height-adjustable plates 14 an 18 it is possible to control the pulp level and froth height in the froth separation reservoir 9.

Below the froth level of froth separation reservoir 9, a washing device 20, consisting preferentially of a pipe extending across the width of froth separation reservoir 9 with sprinklers 21 placed in its lower part spaced apart in the lengthwise direction of the pipe, is set perpendicular to the froth flow. Two baffles, 22 and 23, pivoted on the upper part of a washing device 20 force the froth to flow underneath washing device 20 where sprinklers 21 spray washing water on it.

Figure 2:
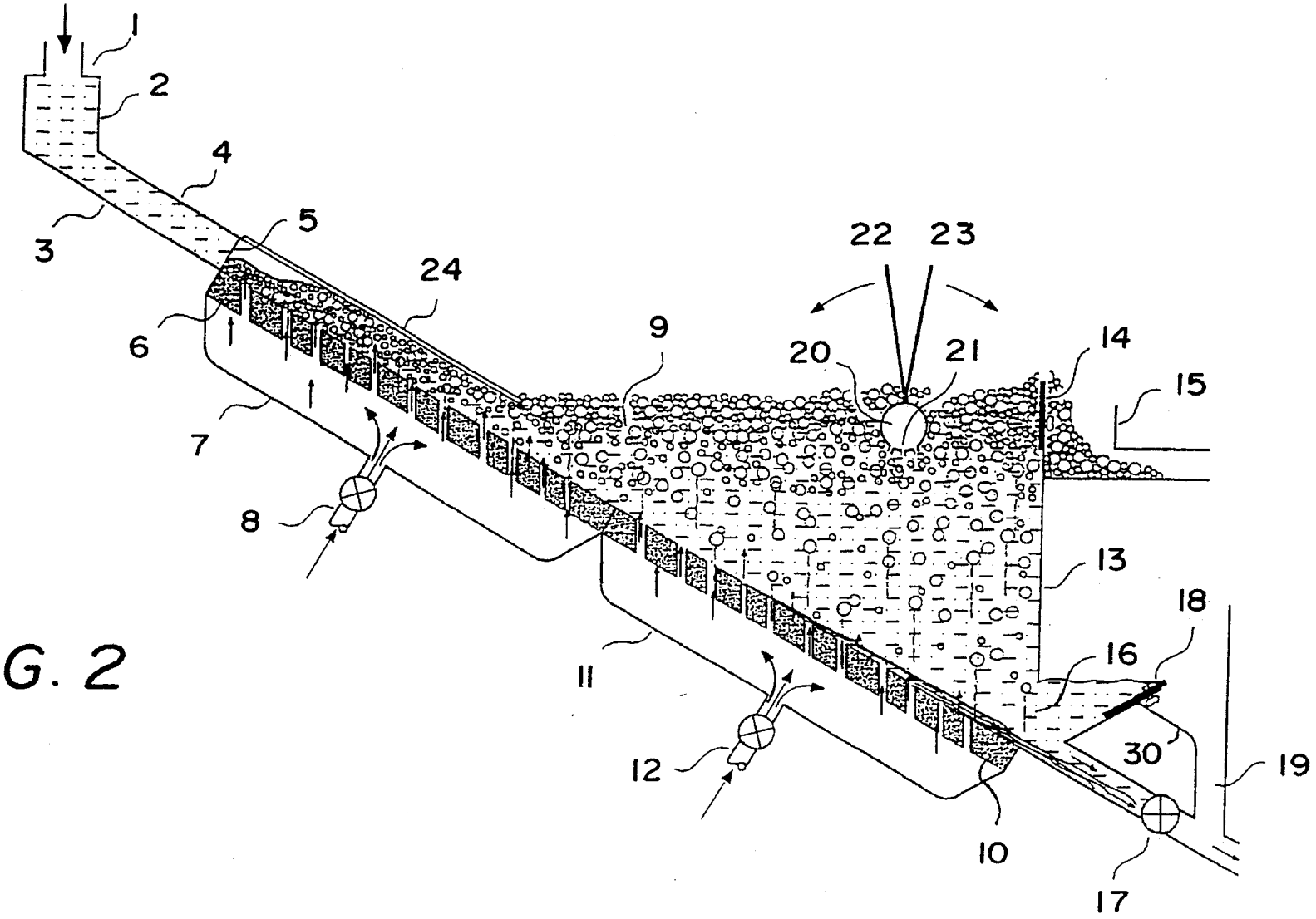
FIG. 2 is a view similar to FIG. 1 but showing a second embodiment of the invention with a non-permeable upper slanted surface placed above an upper part of the lower gas-permeable slanted surface.

FIG. 2 depicts a longitudinal section of a second embodiment of the apparatus in which a non-permeable upper slanted surface 24 is placed above the upper part of the lower gas-permeable slanted surface 6.

In this second embodiment of the apparatus, a more efficient use of the gas is achieved since a greater fraction of the gas injected through lower gas-permeable slanted surface 6 becomes part of the froth phase whereas in the first embodiment of the apparatus some of the bubbles rise through the thin layer pulp and leave toward the atmosphere.

Figure 3:
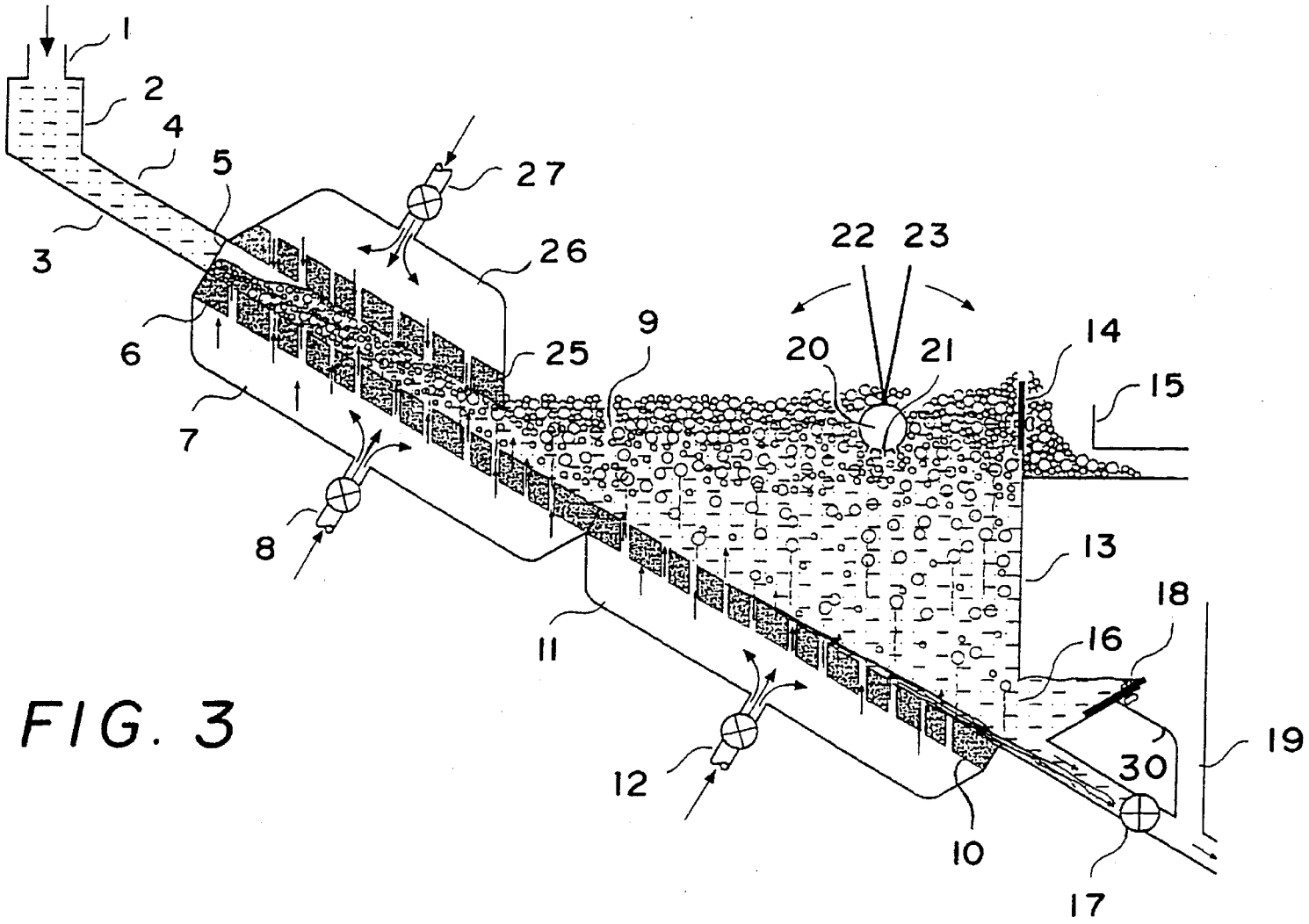
FIG. 3 is a view similar to FIG. 1 but showing a third embodiment of the invention with an upper gas-permeable slanted surface placed above an upper part of the lower gas-permeable slanted surface.

FIG. 3 depicts a longitudinal section of a third embodiment of the apparatus in which a gas-permeable upper slanted surface 25 is placed above the upper part of the lower gas-permeable slanted surface 6. Low pressure gas is injected through gas-permeable upper slanted surface 25 from a gas chamber 26 fed with gas produced and/or compressed externally through a line 27 provided with its own valve and pressure regulators that allow gas flow and pressure control independent of gas chambers 7 and 11.

In this third embodiment of the apparatus, the amount of gas injected into the pulp is larger, which is advantageous in the case of flotation of very fine materials and difficult to float solids. Also, like in the case of the second embodiment, a more efficient use of the gas is achieved since a greater fraction of the gas injected through lower gas-permeable surface 6 and gas-permeable upper slanted surface 25 becomes pad of the froth phase.

The method and apparatus (flotation cell) presented allows many obvious variations that can be considered part of the invention.

An obvious variation is changing the shape of the slanted surfaces, which may include one or more inclined plates (pyramidal surfaces or pyramidal frustums (both convex or concave), conical surfaces or conical frustums (both convex or concave). These different geometries will affect the method selectivity. As a matter of fact, when the width of the slanted surface in the cleaning zone is increased downstream (such as in the case of a pyramidal, convex or conical surfaces as well as trapezoidal planes with a wider lower pad) froth depth diminishes so that the selectivity decreases and recovery increases. The opposite occurs when the surface is reduced downstream such as in the case of pyramidal, conical or concave surfaces as well as trapezoidal planes with a smaller lower part.

Another obvious variation is the addition of grooves or ribs on the slanted surfaces 6, 10, 24 and 25 in order to obtain a uniform distribution of the pulp on the surface.

The material, permeability and pore size of the gas-permeable surface can also be changed by using different materials such as fabrics, ceramics, or any gas-permeable material available. These materials can be natural or synthetic, with the only condition being that they must be inert to the substances involved in the process.

The slope of the slanted gas-permeable surfaces can be changed depending on the nature of the pulp to be treated.

Also, the pulp feeding system can undergo some obvious modifications such as outlets with splitting devices. These devices can be sliding cylinders or descending laminae, set in an adjustable or fixed way.

Each step of the method and corresponding elements of the apparatus can be operated using manual, semi- or automatic control systems.

The economics of the method and apparatus of the invention compare favorably with other methods and apparatus previously described because of nil energy consumption and total residence times of the order of 30 sec, much shorter compared with state-of-the-add flotation machines. Another advantage of the invention is the available number of options for controlling the selectivity-recovery relationship, such as the slope of the slanted gas-permeable surface, depth control of the froth separation reservoir, and baffles that force the froth to flow completely underneath washing devices.

What I claim is:

1. A froth flotation process for recovering hydrophobic particles from a pulp, comprising the steps of:

a) providing a downwardly slanted first gas-permeable surface;

b) feeding a thin layer of pulp onto the first gas-permeable surface, whereby the pulp flows downwardly along the first gas-permeable surface by gravity;

c) supplying a low pressure gas homogeneously through the first gas-permeable surface thereby to generate bubbles that contact and collect hydrophobic materials in the pulp;

d) discharging the aerated pulp into a downstream reservoir formed by a downwardly slanted second gas-permeable surface and a wall at the lower end of the second slanted gas-permeable surface;

e) supplying a low pressure gas homogeneously through the second gas-permeable surface thereby to separate a froth phase containing the hydrophobic material from the pulp, containing hydrophilic solids, flowing downwardly on the second gas-permeable surface;

f) forcing the entire froth in the reservoir to flow underneath a liquid sprinkler by means of baffles disposed transversely to the froth flow and carried by the sprinkler, and washing the froth to cause drainage of the hydrophilic material;

g) discharging the froth accumulated in the reservoir to a launder by permitting the froth to overflow the wall;

h) evacuating the pulp continuously through a discharge means disposed in the lower part of the wall located at the downstream end of the second gas-permeable surface.

2. A froth flotation process as in claim 1, wherein:

a) the thin layer of pulp is a finite thickness less than 5 mm thick.

3. A froth flotation process for recovering hydrophobic particles from a pulp, comprising the steps of:

a) providing a downwardly slanted first gas-permeable surface and an upper downwardly slanted non-gas-permeable surface disposed over the first gas-permeable surface;

b) feeding a thin layer of pulp onto the first gas-permeable surface and underneath the non-gas-permeable surface, whereby the pulp flows downwardly along the first gas-permeable surface by gravity;

c) supplying a low pressure gas homogeneously through the first gas-permeable surface thereby to generate bubbles that contact and collect hydrophobic materials in the pulp, whereby the non-gas-permeable surface causes a greater fraction of the gas to become part of a froth phase;

d) discharging the aerated pulp into a downstream open-topped reservoir formed by a downwardly slanted second gas-permeable surface and a wall at the lower end of the second gas-permeable surface;

e) supplying a low pressure gas homogeneously through the second gas-permeable surface thereby to separate the froth phase containing the hydrophobic material from the pulp, containing hydrophilic solids, flowing downwardly on the second gas-permeable surface;

f) discharging the froth accumulated in the reservoir to a launder by permitting the froth to overflow the wall;

g) evacuating the pulp continuously through a discharge means disposed in the lower part of the wall located at the downstream end of the second slanted gas-permeable surface.

4. A froth flotation process as in claim 3, and further comprising the steps of:

a) forcing the entire froth in the reservoir to flow underneath a liquid sprinkler; and b) washing the froth in the reservoir with the liquid sprinkler as the froth flows underneath.

5. A froth flotation process as in claim 3, wherein:

a) the thin layer of pulp is a finite thickness less than 5 mm thick.

6. A froth flotation process for recovering hydrophobic particles from a pulp, comprising the steps of:

a) providing a downwardly slanted first gas-permeable surface and a slanted second gas-permeable surface disposed above the first gas-permeable surface;

b) feeding a thin layer of pulp onto the first gas-permeable surface and below the second gas-permeable surface, whereby the pulp flows downwardly along the first gas-permeable surface by gravity;

c) supplying a low pressure gas homogeneously through the first gas-permeable surface and second gas-permeable surface thereby to generate bubbles that contact and collect hydrophobic materials in the pulp;

d) discharging the aerated pulp into a downstream reservoir formed by a downwardly slanted third gas-permeable surface and a wall at the lower end of the third gas-permeable surface;

e) supplying a low pressure gas homogeneously through the third gas-permeable surface thereby to separate a froth phase containing the hydrophobic material from the pulp, containing hydrophilic solids, flowing downwardly on the third gas-permeable surface;

f) discharging the froth accumulated in the reservoir to a launder by permitting the froth to overflow the wall;

g) evacuating the pulp continuously through a discharge means disposed in the lower part of the wall located at the downstream end of the third gas-permeable surface.

7. A froth flotation process as in claim 6, and further comprising the steps of:

a) forcing the entire froth in the reservoir to flow underneath a liquid sprinkler; and b) washing the froth in the reservoir with the liquid sprinkler as the froth flows underneath.

8. A froth flotation process as in claim 6, wherein:

a) the thin layer of pulp is a finite thickness less than 5 mm thick.

9. A froth flotation apparatus for material separation, comprising:

a) a downwardly slanted first gas-permeable surface for receiving a thin layer of pulp from a pulp distributor, whereby the pulp flows downwardly along said first gas-permeable surface by gravity;

b) a first gas chamber disposed below said first gas-permeable surface for supplying low pressure gas through said first gas-permeable surface, thereby to generate bubbles that contact and collect hydrophobic materials in the pulp;

c) a reservoir disposed downstream of said first gas-permeable surface, said reservoir having a second gas-permeable surface and a wall disposed downstream of said second gas-permeable surface, said second gas-permeable surface being disposed to receive the aerated pulp from said first gas-permeable surface;

d) a second gas chamber disposed below said second gas-permeable surface for supplying low pressure gas through said second gas-permeable surface, thereby to separate a froth phase containing the hydrophobic material from the pulp, containing hydrophilic solids, flowing downwardly on said second gas-permeable surface, whereby the froth accumulating in said reservoir is permitted to overflow said wall and discharge to a launder;

e) a cleaning liquid sprinkler disposed above said reservoir for washing the froth thereby to cause the hydrophilic material to settle down;

f) baffles disposed transversely above said reservoir and carried by said sprinkler, said baffles being adapted to cause the entire froth to flow underneath said sprinkler; and g) a discharge disposed at a lower part of said wall for evacuating the pulp continuously from said reservoir.

10. An apparatus as in claim 9, wherein:

a) said baffles are inclination adjustable.

11. An apparatus as in claim 9, wherein:

a) said wall is height adjustable.

12. An apparatus as in claim 9, and further comprising:

a) a duct connected to said discharge, said duct including a height-adjustable plate at its top for adjusting the overflow of the pulp.

13. An apparatus as in claim 9, wherein:

a) said discharge includes a valve.

14. A froth flotation apparatus for material separation, comprising:

a) a downwardly slanted first gas-permeable surface for receiving a thin layer of pulp from a pulp distributor, whereby the pulp flows downwardly along said first gas-permeable surface by gravity;

b) an upper downwardly slanted non-gas-permeable surface disposed over said first gas-permeable surface;

c) a first gas chamber disposed below said first gas-permeable surface for supplying low pressure gas through said first gas-permeable surface, thereby to generate bubbles that contact and collect hydrophobic materials in the pulp, whereby said non-gas-permeable surface causes a greater fraction of the gas to become part of a froth phase;

d) an open-topped reservoir disposed downstream of said first gas-permeable surface, said reservoir having a downwardly slanted second gas-permeable surface and a wall disposed downstream of said second gas-permeable surface, said second gas-permeable surface being disposed to receive the aerated pulp from said first gas-permeable surface;

e) a second gas chamber disposed below said second gas-permeable surface for supplying low pressure gas through said second gas-permeable surface, thereby to separate the froth phase containing the hydrophobic material from the pulp, containing hydrophilic solids, flowing downwardly on said second gas-permeable slanted surface, whereby the froth accumulating in said reservoir is permitted to overflow said wall and discharge to a launder; and f) a discharge disposed at a lower part of said wall for evacuating the pulp continuously from said reservoir.

15. An apparatus as in claim 14, and further comprising:

a) a cleaning liquid sprinkler disposed above said reservoir for washing the froth thereby to cause the hydrophilic material to settle down.

16. An apparatus as in claim 15, and further comprising:

a) baffles disposed above said reservoir and carried by said sprinkler, said baffles being adapted to cause the entire froth to flow underneath said sprinkler.

17. An apparatus as in claim 16, wherein:

a) said baffles are inclination adjustable.

18. An apparatus as in claim 14, wherein:

a) said wall is height adjustable.

19. An apparatus as in claim 14, and further comprising:

a) a duct connected to said discharge, said duct including a height-adjustable plate at its top for adjusting the overflow of the pulp.

20. A froth flotation apparatus for material separation, comprising:

a) a downwardly slanted first gas-permeable surface for receiving a thin layer of pulp from a pulp distributor, whereby the pulp flows downwardly along said first gas-permeable surface by gravity;

b) a slanted second gas-permeable surface disposed over said first gas-permeable surface;

c) first and second gas chambers disposed below said first gas-permeable surface and above said second gas-permeable surface, respectively, for supplying low pressure gas through said first and second gas-permeable surfaces, thereby to generate bubbles that contact and collect hydrophobic materials in the pulp;

d) a reservoir disposed downstream of said first gas-permeable surface, said reservoir having a downwardly slanted third gas-permeable surface and a wall disposed downstream of said third gas-permeable surface, said third gas-permeable surface being disposed to receive the aerated pulp from said first gas-permeable surface;

e) a third gas chamber disposed below said third gas-permeable surface for supplying low pressure gas through said third gas-permeable surface, thereby to separate a froth phase containing the hydrophobic material from the pulp, containing hydrophilic solids, flowing downwardly on said third gas-permeable surface, whereby the froth accumulating in said reservoir is permitted to overflow said wall and discharge to a launder; and f) a discharge disposed at a lower part of said wall for evacuating the pulp continuously from said reservoir.

21. An apparatus as in claim 20, and further comprising:

a) a cleaning liquid sprinkler disposed above said reservoir for washing the froth thereby to cause the hydrophilic material to settle down.

22. An apparatus as in claim 21, and further comprising:

a) baffles disposed above said reservoir and carried by said sprinkler, said baffles being adapted to cause the entire froth to flow underneath said sprinkler.

23. An apparatus as in claim 22, wherein:

a) said baffles are inclination adjustable.

24. An apparatus as in claim 20, wherein:

a) said wall is height adjustable.

25. An apparatus as in claim 20, and further comprising:

a) a duct connected to said discharge, said duct including a height-adjustable plate at its top for adjusting the overflow of the pulp.

* * * * *